US009453383B2

(12) United States Patent
Telfer

(10) Patent No.: US 9,453,383 B2
(45) Date of Patent: Sep. 27, 2016

(54) MODULAR TOOL FOR WELLBORE CLEANING

(75) Inventor: George Telfer, Aberdeen (GB)

(73) Assignee: M-I DRILLING FLUIDS U.K. LIMITED, Aberdeen (GB)

( * ) Notice: Subject to any disclaimer, the term of this patent is extended or adjusted under 35 U.S.C. 154(b) by 631 days.

(21) Appl. No.: 13/294,703

(22) Filed: Nov. 11, 2011

(65) Prior Publication Data

US 2012/0118576 A1 May 17, 2012

(30) Foreign Application Priority Data

Nov. 12, 2010 (GB) ..... 1019174.0

(51) Int. Cl.
*E21B 27/00* (2006.01)

(52) U.S. Cl.
CPC ..... *E21B 27/00* (2013.01)

(58) Field of Classification Search
CPC ..... E21B 37/00; E21B 27/00; E21B 27/005
USPC ..... 166/99, 162, 311, 105.1, 105.3, 105.4; 175/323
See application file for complete search history.

(56) References Cited

U.S. PATENT DOCUMENTS

| | | | | |
|---|---|---|---|---|
| 2,915,125 | A | 12/1959 | Hanes | |
| 3,841,489 | A * | 10/1974 | Combest | B01D 35/02 210/223 |
| 4,084,636 | A * | 4/1978 | Burge | 166/66.5 |
| 5,176,208 | A | 1/1993 | Lalande et al. | |
| 5,402,850 | A | 4/1995 | Lalande et al. | |
| 6,176,311 | B1 * | 1/2001 | Ryan | E21B 21/002 166/99 |
| 7,610,957 | B2 * | 11/2009 | Davis et al. | 166/99 |
| 7,753,113 | B1 | 7/2010 | Penisson | |
| 2002/0053428 | A1 | 5/2002 | Maples | |
| 2004/0251023 | A1 | 12/2004 | Pluchek et al. | |
| 2012/0292047 | A1 * | 11/2012 | Knobloch, Jr. | E21B 21/12 166/378 |

FOREIGN PATENT DOCUMENTS

| | | | |
|---|---|---|---|
| GB | 2441246 | B | 5/2009 |
| GB | 2469724 | A | 10/2010 |

OTHER PUBLICATIONS http://www.thefreedictionary.com/on.*

(Continued)

*Primary Examiner* — Blake Michener
*Assistant Examiner* — Wei Wang
(74) *Attorney, Agent, or Firm* — David J. Smith

(57) ABSTRACT

Modular debris chambers of a debris extraction tool and a method for collecting debris using such modular debris chambers are disclosed. The modular debris chamber for a debris extraction tool may include a plurality of debris chambers. The modular debris chamber may include a bucket for collecting debris, an inner flow tube being concentrically arranged within the bucket, and a deflector arranged in a lower end of the bucket for deflecting a flow of debris from the inner flow tube of a subsequent modular debris chamber connectable to a lower end of the modular debris chamber. The method for collecting debris using a modular debris chamber may include a plurality of the modular debris chambers interconnected to form a debris extraction tool, and reflecting fluid off the deflector allowing solid debris in the flow of debris to deflect off the deflector into the bucket of a subsequent modular debris chamber.

15 Claims, 5 Drawing Sheets

(56) References Cited

OTHER PUBLICATIONS

Search Report issued in British Application No. GB1019174.0; Dated Jan. 26, 2011 (3 pages).
Canadian Examination Report for corresponding Canadian Application No. 2,817,638, dated Oct. 16, 2015, 6 pages.
Second Australian Examination Report for corresponding Australian Application No. 2011327889, dated Dec. 4, 2015, 3 pages.
International Search Report and Written Opinion for corresponding International Application No. PCT/GB2011/052190, dated Sep. 6, 2012, 10 pages.
Canadian Office Action for corresponding Canadian Application No. 2,817,638, dated Mar. 3, 2014, 2 pages.
Canadian Office Action for corresponding Canadian Application No. 2,817,638, dated Jan. 15, 2015, 6 pages.
Australian Office Action for corresponding Australian Application No. 2011327889, dated Mar. 3, 2015, 3 pages.
Notice of Acceptance for corresponding Australian Application No. 2011327889, dated Mar. 1, 2016, 2 pages.
Examination Report issued in British Application No. GB1019174.0; Dated May 16, 2016 (4 pages).

* cited by examiner

MODULAR TOOL FOR WELLBORE CLEANING

BACKGROUND

The technical field of the present invention relates to wellbore cleaning. More particularly, the technical field of the present invention relates to modular debris chambers of a debris extraction tool and a method for collecting debris using such modular debris chambers.

In recent years, attention has been given to the use of debris extraction tools for wellbore cleaning. GB 2441246B discloses a device and method for retrieving debris from a well using a venturi debris extraction tool and may be useful background art for understanding the present invention. Venturi debris extraction tools are used to create a downhole 'reverse circulation' path to encourage loose debris to be drawn into a collecting chamber. This chamber may be long and requires to be dismantled on the rig floor when pulled from the well. The chamber often contains heavy brine which is considered hazardous on skin contact. A system and/or method for collecting this brine efficiently and any debris would be advantageous.

In view of the prior art discussed above, there is a need to be able to collect brine and/or debris with a debris extraction tool without loosing too much power of the downhole reverse circulation path. In one embodiment, the debris chambers should aid circulation within the debris extraction tool. It is desirable that debris chambers should collect debris and allow for the fluid to flow as freely as possible through the debris chambers while at the same time allow solid debris to be collected in the debris chambers.

A further need is to avoid unwanted fluid (brine) spillage from a of debris extraction tool. There is a need to be able to collect brine and/or debris in a safe and controlled manner. This would allow for a cleaner environment and compliance with any regulations in this regard. Additionally, it is desirable to avoid the cumbersome arrangements from a technical and/or economical point of view.

SUMMARY

One or more embodiments of the present disclosure provides a modular tool for wellbore cleaning. This may be achieved by the features of the independent claims. Further enhancements are characterized by the dependent claims.

According to one embodiment, a modular debris chamber for a debris extraction tool may include a plurality of debris chambers. The modular debris chamber may include a bucket for collecting debris, an inner flow tube being concentrically arranged within the bucket, and a deflector arranged in a lower end of the bucket for deflecting a flow of debris from the inner flow tube of a subsequent modular debris chamber connectable to a lower end of the modular debris chamber.

According to one embodiment, a distance between the deflector and a top end opening of the inner flow tube of a subsequent modular debris chamber is arranged to ensure debris carried in the fluid of the inner flow tube of a subsequent modular debris chamber falls out into each bucket, when the modular debris chamber and the subsequent modular debris chamber are connected. The distance may be a function of the flow rate of the fluid, the type of fluid, and the size of the tool. In one embodiment, the distance is from about 1 inch (2.5 cm) to about 5 inches (12.5 cm), for example, about 3 inches (7.5 cm).

According to one embodiment, the deflector may include sealing means, mounting means for mounting the deflector to the debris chamber, and a conduit for the debris flow of the inner flow tube. The mounting means may include at least three balls, an inner body comprising the conduit, and a snap ring. The snap ring may locate the at least three balls to engage a groove of the debris chamber thereby mounting the deflector in the debris chamber.

According to one embodiment, the sealing means holds the inner flow tube and seals against the bucket. According to one embodiment, the deflector may comprise a shape such that solid debris in the flow of debris is deflected into the bucket of a subsequent modular debris chamber. The central surface of the shape of the deflector may be above, in the direction of the modular debris chamber, an inlet of the conduit. In certain embodiments, the shape may be a concave or a flat shape.

According to one embodiment, the deflector may comprise an inlet to the inner flow tube and the inlet may be situated in a periphery of the deflector. According to one embodiment, the modular debris chamber may be part of a venturi debris extraction tool.

According to one embodiment, a method for collecting debris using such a modular debris chamber may include a plurality of the modular debris chambers interconnected to form the debris chambers of a debris extraction tool, and reflecting fluid off the deflector allowing solid debris in the flow of debris to deflect off the deflector into the bucket of a subsequent modular debris chamber.

Hereby a modular tool for wellbore cleaning is provided. The embodiments collect efficiently brine and any debris. Due to the deflection brine and/or debris may be collected with a debris extraction tool without loosing too much power of the downhole reverse circulation path. The debris chambers may aid circulation within a debris extraction tool. The debris chambers may collect debris and allow for the fluid to flow as freely as possible through the debris chambers while at the same time allow solid debris to be collected in the debris chambers.

Other technical advantages of the present disclosure will be readily apparent to one skilled in the art from the following description and claims. Various embodiments of the present application obtain only a subset of the advantages set forth. No one advantage is critical to the embodiments. Any claimed embodiment may be technically combined with any preceding claimed embodiment(s). The words "upper" and "lower" are in relation to the orientation of a debris chamber in a debris extraction tool in a wellbore.

BRIEF DESCRIPTION OF DRAWINGS

The accompanying drawings, which are incorporated in and constitute a part of the specification, illustrate presently embodiments of the invention, and together with the general description given above and the detailed description of the embodiments given below, serve to explain, by way of example, the principles of the invention.

DETAILED DESCRIPTION

Figure 1:
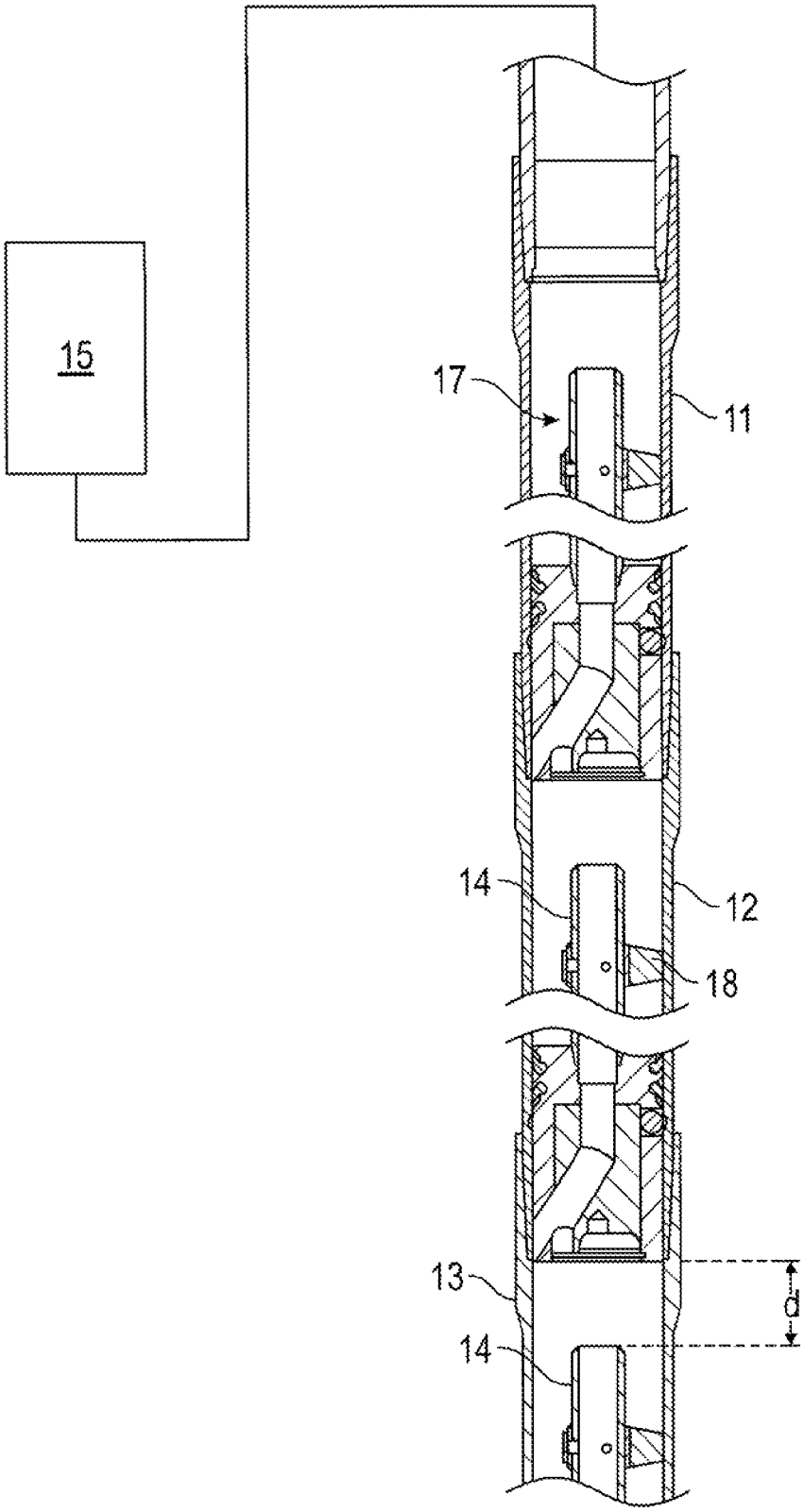
FIG. 1 shows an exemplary embodiment of modular debris chambers.

FIG. 1 illustrates an exemplary embodiment of a debris chamber. Such a debris chamber may be part of a debris extraction tool, and especially a venturi debris extraction tool. The illustrated embodiment is a longitudinal half-sectional view of a first debris chamber 11 connected to a second debris chamber 12 connected to a third debris chamber 13. These debris chambers 11-13 may be modular. The first debris chamber 11 is the upper debris chamber when considering the debris chambers 11-13 as part of a debris extraction tool positioned within a well. The third debris chamber 13 is the lower debris chamber when considering the debris chambers 11-13 as part of a debris extraction tool positioned within a well. Any suitable amount of debris chambers may be used. The lowest debris chamber may be connected to a bottom sub for extracting debris. The upper debris chamber may be connected to a debris screening module which in turn may be connected to an engine module 15. The engine module is schematically illustrated in FIG. 1. Such an engine module 15 may operate according to the venturi principle for circulating fluid for the debris extraction tool. The engine module 15 may be used by the (venturi) debris extraction tool to create a downhole reverse circulation path to encourage loose debris to be drawn into the debris chambers 11-13.

The debris extraction tool may be utilised for retrieving debris from a well, which may comprise part of a tool or tool string located in a borehole, or other junk typically found downhole. The debris extraction tool may therefore be utilised in a "fishing" operation, to retrieve part of a tool which has become lodged and stuck in a casing of a borehole. The debris extraction tool may also be utilised for retrieving other debris such as cement lumps, rocks, congealed mud, oxidation lumps, metal debris, scale, slivers, shavings, burrs, water, dislodged mud cake residue, drill cuttings or the like which has accumulated in the casing of a borehole, and which is to be cleaned and removed prior to completion of a well. The debris chambers may collect fluid, such as brine, comprising such debris.

When in operation, the debris extraction tool moves fluid, brine, within the debris chambers. Debris may consequently be collected in the debris chambers 11-13. The debris chamber 11, 12, or 13 in the exemplary embodiment in FIG. 1 comprises an inner flow tube 14. The inner flow tube 14 may be centrally arranged within the debris chamber 11, for example, positioned concentric within the debris chamber 11 in the axial direction of the debris chamber 11.

The fluid moves up through the debris extraction tool, up through the debris chambers 11-13. When the fluid moves through a debris chamber, the fluid may move through the inner flow tube 14. When fluid comprising debris exits a top end opening 16 of the inner flow tube 14, the velocity of the fluid slows and this allows the debris to fall into a bucket 17 of the debris chamber.

According to one embodiment, the debris chambers are modularised. Modular debris chambers 11-13 may be interconnected such that a subsequent debris chamber 12 may be beneath the first modular debris chamber 11, and a subsequent debris chamber 13 may be beneath the second modular debris chamber 12. According to one embodiment, the interconnection allow for the fluid to flow as freely as possible through the debris chambers while at the same time allow solid debris to be collected in the debris chambers.

Figure 2:
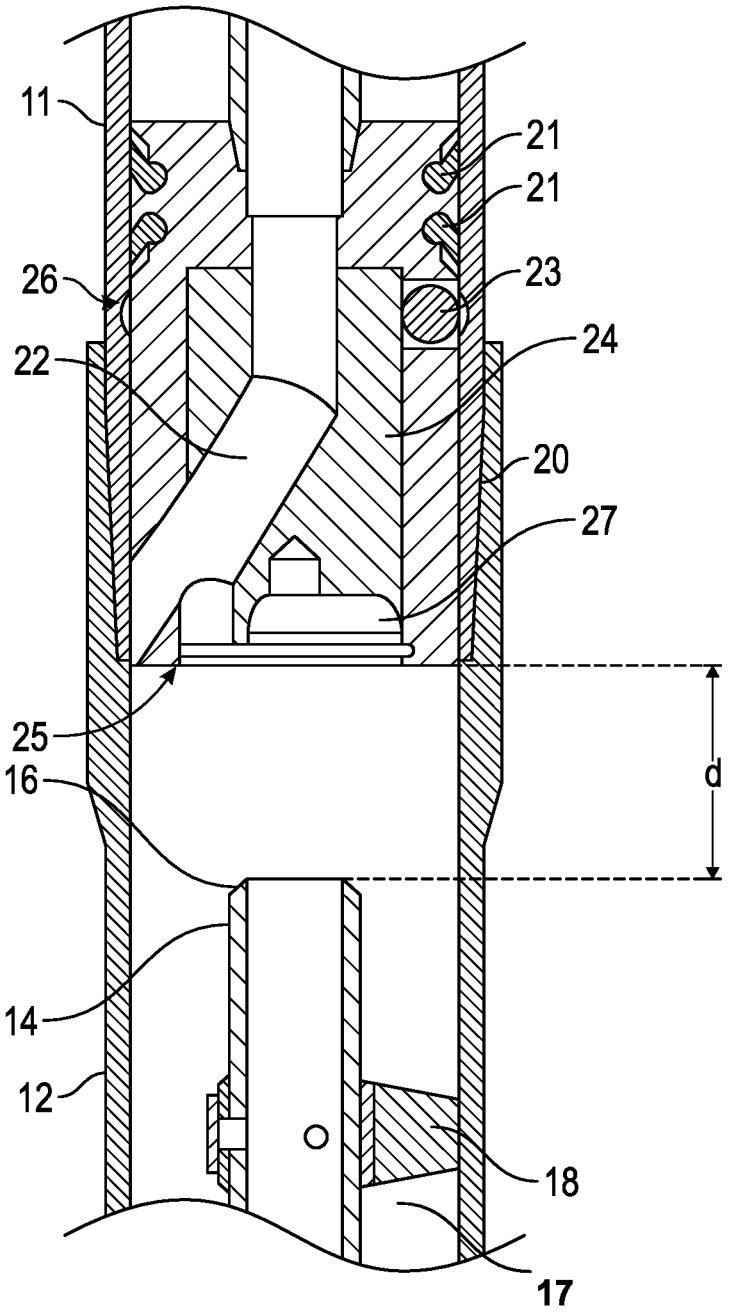
FIG. 2 shows an exemplary embodiment of a connection between two debris chambers.

FIG. 2 shows an exemplary embodiment of a connection between two debris chambers. The connection takes place by connecting a lower end of an upper debris chamber with an upper end of a lower debris chamber.

Figure 3:
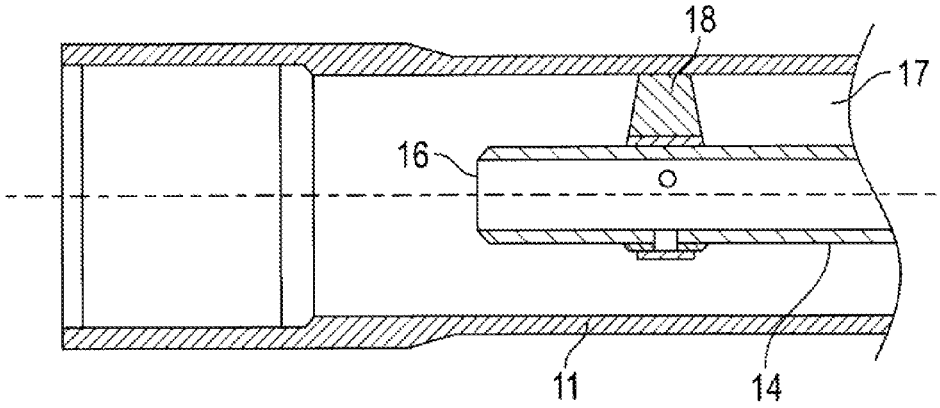
FIG. 3 shows an exemplary embodiment of an upper end of a debris chamber.

Turning to FIG. 3, an exemplary embodiment of an upper end of a debris chamber 11 is illustrated. The top end opening 16 of the inner flow tube 14 ends within the bucket 17. An inner tube positioner 18 holds the inner flow tube 14 within the debris chamber 11. The concentric position of the inner flow tube 14 within the debris chamber 11 is indicated by the central broken line.

Figure 4:
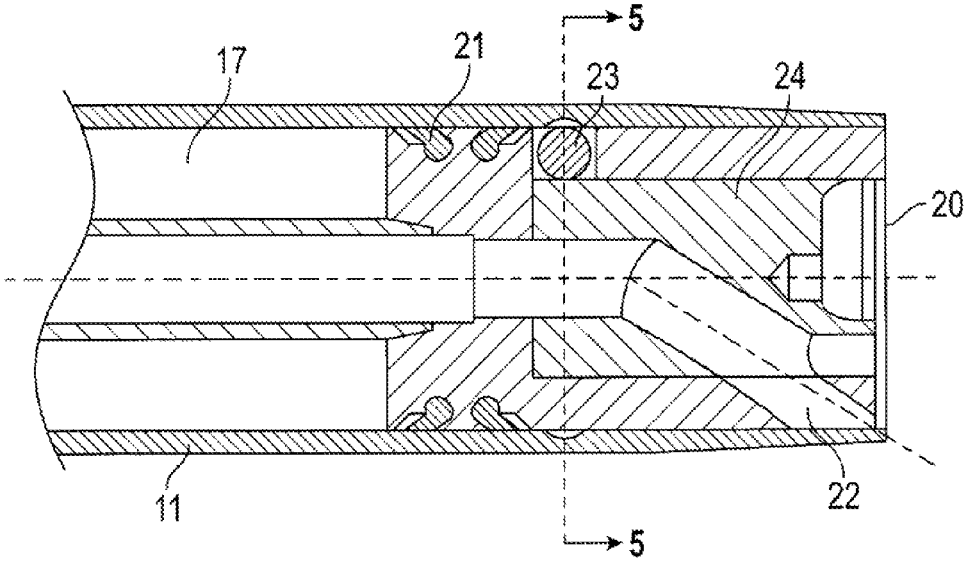
FIG. 4 shows an exemplary embodiment of a lower end of a debris chamber.

FIG. 4 illustrates an exemplary embodiment of a lower end of a debris chamber 11. A deflector 20 may deflect fluid flow from the top end opening 16 of the inner flow tube 14 of a subsequent modular debris chamber and may ensure that debris carried in the fluid of the inner flow tube 14 of a subsequent modular debris chamber falls out into each bucket 17, respectively, when the modular debris chamber 11 is connected with the subsequent modular debris chamber 12.

FIG. 2 illustrates the connection of the two embodiments illustrated in FIGS. 3 and 4. A distance d between the deflector 20 and a top end opening 16 of the inner flow tube 14 of a subsequent modular debris chamber is arranged to ensure debris carried in the fluid of the inner flow tube 14 of a subsequent modular debris chamber falls out into each bucket 17, when the modular debris chamber 11 and the subsequent modular debris chamber 12 are connected. The distance d may be a function of the flow rate of the fluid, the type of fluid, and the size of the tool. According to one embodiment, the distance d is from about 1 inch (2.5 cm) to about 5 inches (12.5 cm), for example, about 3 inches (7.5 cm). The distance d may be optimized in order to ensure that debris carried in the fluid of the inner flow tube 14 will fall out into each of the buckets 17.

According to one embodiment, the deflector may include sealing means 21, mounting means 23, 24, and 25 for mounting the deflector to the debris chamber, and a conduit 22 for the debris flow of the inner flow tube 14. According to one embodiment, the mounting means may include at least three balls 23, an inner body 24 comprising the conduit 22, and a snap ring 25. The snap ring 25 may locate the at least three balls 23 to engage a groove 26 of the debris chamber 11 thereby mounting the deflector 20 in the debris chamber 11. The sealing means 21 may hold the inner flow tube 14 concentrically within the debris chamber. The sealing means 21 may seal against an inner wall of the bucket 17. In this way the deflector 20 may be located accurately and conveniently within the debris chamber 11.

Figure 5:
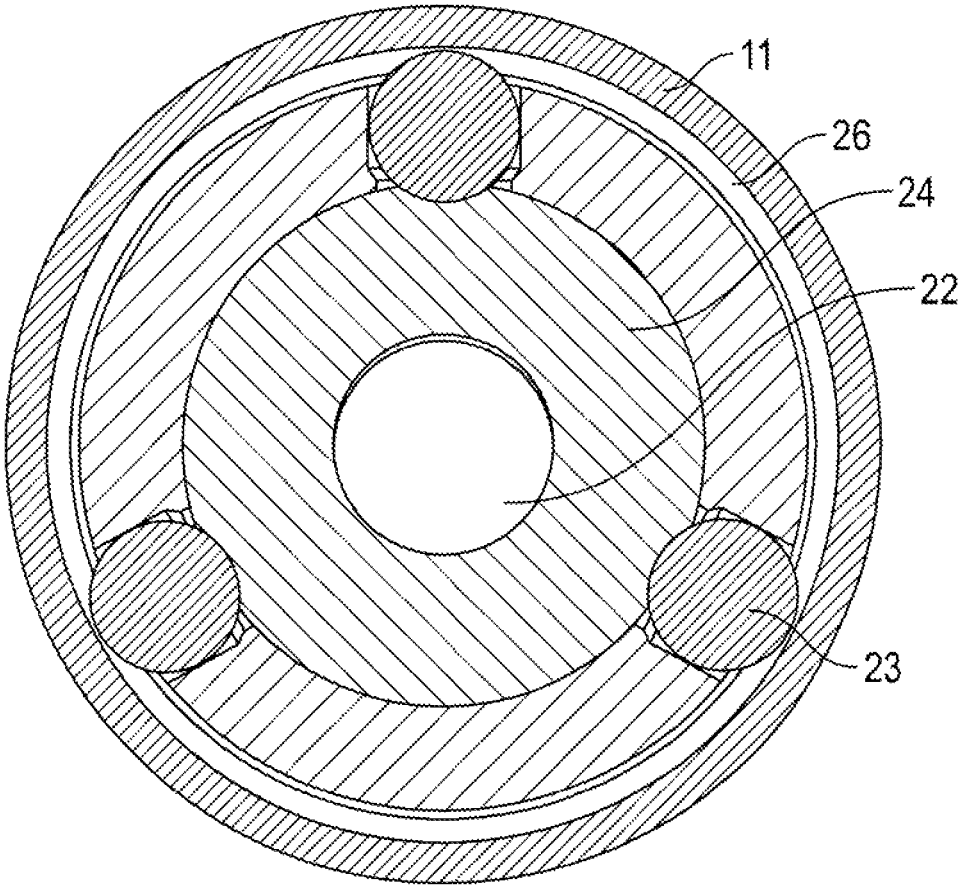
FIG. 5 shows an exemplary embodiment of a cross section A-A from FIG. 4.
Figure 6:
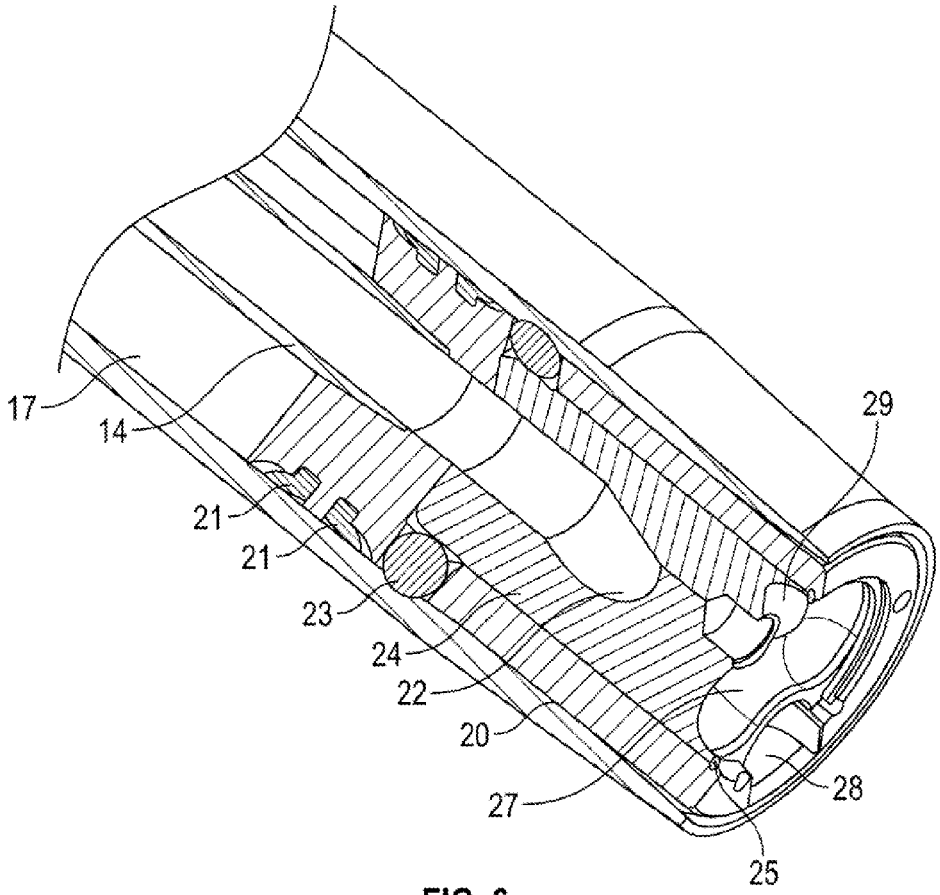
FIG. 6 shows an exemplary embodiment of a lower end of a debris chamber.

While FIG. 4 shows an exemplary embodiment of a lower end of a debris chamber 11, FIG. 5 shows an exemplary embodiment of the cross section A-A from FIG. 4. The balls 23 are spaced 120 degrees from each other and engage the groove 26 of the debris chamber 11. By mounting the deflector 20 in this manner the distance d may be assured. This may allow for a simple and effective way to mount the inner flow tube 14 in the debris chamber 11.

According to one embodiment, the deflector 20 includes a shape 27 such that solid debris in the flow of debris is deflected off the shape 27 of the deflector 20 into the bucket 17 of a subsequent modular debris chamber. A central area 29 of the surface of the shape of the deflector 20 is above, in the direction of the modular debris chamber, an inlet 28 of the conduit 22. The central area 29 may be axially opposite the top end opening 16 of the inner flow tube 14. This may effectively deflect solid debris in the fluid into the bucket 17 while allow proper circulation of the fluid within the debris extraction tool. The shape 27 may be a concave or a flat shape.

According to one embodiment, the deflector 20 may include an inlet 28 to the inner flow tube 14. The inlet 28 may be situated in a periphery of the deflector 20. The inlet 28 may be off center. The top end opening 16 of the inner flow tube 14 may not be opposite the inlet 28. This arrangement promotes solid debris to deflect off the deflector and to be collected in the bucket 17.

According to one embodiment, the modular debris chamber may be part of a venturi debris extraction tool. Hereby a good circulation of the fluid within the tool and its modular debris chambers is achieved without having to use an excessive amount of fluid. Due to the deflection brine and/or debris may be collected with a debris extraction tool without loosing too much power of the downhole reverse circulation path.

In use the modular debris chambers may be connected to form a long collecting device. Any suitable numbers of modular debris chambers may be connected. The plurality of debris chambers may form a collecting device for a debris extraction tool, such as a venturi debris extraction tool. A tool comprising the modular debris chamber overcomes the disadvantages mentioned above and has the advantages mentioned above.

According to one embodiment, a method for collecting debris may use a modular debris chamber as disclosed above. A plurality of the modular debris chambers 11, 12, and 13 may be interconnected to form the debris chambers of a debris extraction tool. Fluid circulating may be reflected off the deflector 20 allowing solid debris in the flow of debris to deflect off the deflector 20 into the bucket 17 of a subsequent modular debris chamber. The subsequent modular debris chamber is the debris chamber just below the deflector.

The method allows for an efficient circulation of the fluid within a tool, especially within its modular debris chambers. The fluid moving out of the inner flow tubes is deflected off the deflector ensuring debris is collected in the bucket. Due to the deflection, brine and/or debris may be collected with a debris extraction tool without loosing too much power of the downhole reverse circulation path.

The modular debris chamber and method discussed above provides a modular tool for wellbore cleaning. Embodiments of the present disclosure may provide the ends and advantages mentioned, as well as others inherent therein. While the invention has been described and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The described embodiments of the invention are exemplary only, and are not exhaustive of the scope of the invention. Consequently, the invention is intended to be limited only by the scope of the appended claims, giving full cognizance to equivalents in all respects.

The invention claimed is:

1. A downhole apparatus comprising:

a plurality of modular debris chambers, wherein each of the plurality of modular debris chambers comprises:

a bucket for collecting debris;

an inner flow tube being concentrically arranged within the bucket;

a deflector arranged at a lower end of the bucket and being separate from an inlet to the inner flow tube, the deflector of a first modular debris chamber of the plurality of modular debris chambers being configured to deflect a flow of debris from the inner flow tube of a second modular debris chamber of the plurality of modular debris chambers into the bucket of the second modular debris chamber, wherein the second modular debris chamber is connected to a lower end of the first modular debris chamber; and wherein the deflector comprises:

a seal; and a conduit for the flow of debris of the inner flow tube, wherein the inlet is disposed on a lower end of the conduit.

2. The apparatus according to claim 1, wherein a distance between the deflector of the first modular debris chamber and a top end opening of the inner flow tube of the second modular debris chamber is arranged to ensure the flow of debris from the inner flow tube of the second-modular debris chamber falls out into the bucket of the second modular debris chamber, when the first modular debris chamber and the second modular debris chamber are connected.

3. The apparatus according to claim 2, wherein the distance is a function of a flow rate of a fluid, a type of fluid, and a size of the apparatus.

4. The apparatus according to claim 2, wherein the distance is from about 1 inch (2.5 cm) to about 5 inches (12.5 cm).

5. The apparatus according to claim 1, wherein the deflector further comprises:

at least three balls;

an inner body comprising the conduit; and a snap ring, wherein the snap ring locates the at least three balls to engage a groove of the first modular debris chamber thereby mounting the deflector in the first modular debris chamber.

6. The apparatus according to claim 1, wherein the seal holds the inner flow tube and seals against the bucket.

7. The apparatus according to claim 1, wherein the deflector comprises a seal and a conduit for the debris flow of the inner flow tube, wherein a central surface of the shape of the deflector is above, in the direction of the first modular debris chamber, an inlet of the conduit.

8. The apparatus according to claim 1 wherein the deflector further includes a shape, wherein the shape is a concave or a flat shape.

9. The apparatus according to claim 8, wherein at least a portion of the shape is located on a central axis of the modular debris chamber.

10. The apparatus according to claim 8, wherein the inlet is located at a position axially lower than a central area of the shape.

11. The apparatus according to claim 1, wherein a venturi debris extraction tool comprises the plurality of modular debris chambers.

12. A method comprising:

interconnecting a plurality of modular debris chambers to form a downhole debris extraction tool, wherein each of the plurality of modular debris chambers comprises:

a bucket for collecting debris;

an inner flow tube being concentrically arranged within the bucket;

a deflector arranged at a lower end of the bucket and being separate from an inlet to the inner flow tube, the deflector of a first modular debris chamber of the plurality of modular debris chambers being configured to deflect a flow of debris from the inner flow tube of a second modular debris chamber of the plurality of modular debris chambers into the bucket of the second modular debris chamber, wherein the second modular debris chamber is connected to a lower end of the first modular debris chamber; and wherein the deflector comprises:

a seal; and a conduit for the flow of debris of the inner flow tube, wherein the inlet is disposed on a lower end of the conduit; and reflecting fluid off a shape of the deflector allowing solid debris in the flow of debris to deflect off the shape of the deflector into the bucket of the second modular debris chamber.

13. The method according to claim 12, further comprising:

mounting the deflector within the at least one of the plurality of modular debris chambers by using a snap ring to locate a ball within a groove of the at least one of the plurality of modular debris chambers.

14. A downhole apparatus comprising:

a plurality of modular debris chambers, wherein each of the plurality of modular debris chambers comprises:

a bucket for collecting debris;

an inner flow tube being concentrically arranged within the bucket;

a conduit fluidly connected to a lower end of the inner flow tube, the conduit being angled with respect to the inner flow tuber; and a deflector arranged at a lower end of the bucket, a bottom surface thereof being laterally adjacent to the inlet of the conduit, the deflector of a first modular debris chamber of the plurality of modular debris chambers being configured to deflect a flow of debris from the inner flow tube of a second modular debris chamber of the plurality of modular debris chambers into the bucket of the second modular debris chamber, wherein the second modular debris chamber is connected to a lower end of the first modular debris chamber.

15. The apparatus of claim 14, wherein an inlet to the conduit is laterally offset relative to the inner flow tube.

* * * * *